US006899579B1

(12) United States Patent
Bruestle

(10) Patent No.: US 6,899,579 B1
(45) Date of Patent: May 31, 2005

(54) MARINE PROPULSION DEVICE WITH VARIABLE AIR INTAKE SYSTEM

(75) Inventor: Claus Bruestle, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/698,094

(22) Filed: Oct. 31, 2003

(51) Int. Cl.[7] ..... B63H 21/10; F02F 7/00
(52) U.S. Cl. ..... 440/88 A; 440/77; 123/195 C
(58) Field of Search ..... 440/76, 77, 88 A, 440/88 R; 123/41.04, 41.05, 41.07, 195 C, 123/184.56, 344

(56) References Cited

U.S. PATENT DOCUMENTS

| | | | | |
|---|---|---|---|---|
| 4,722,709 | A | 2/1988 | Irwin et al. | |
| 4,734,070 | A | 3/1988 | Mondek | |
| 4,860,703 | A | 8/1989 | Boda et al. | |
| 5,052,353 | A | 10/1991 | Dunham et al. | |
| 5,340,343 | A * | 8/1994 | Kawamukai et al. | 440/77 |
| 5,573,436 | A | 11/1996 | Trudeau et al. | |
| 6,056,611 | A | 5/2000 | House et al. | |
| 6,302,749 | B1 | 10/2001 | Tawa et al. | |
| 6,413,131 | B1 | 7/2002 | Phillips et al. | |
| 6,726,512 | B2 * | 4/2004 | Saito | 440/87 |

FOREIGN PATENT DOCUMENTS

| | | | | |
|---|---|---|---|---|
| JP | 2-21295 | * | 8/1990 | 440 77 |

* cited by examiner

*Primary Examiner*—Andrew D. Wright
(74) *Attorney, Agent, or Firm*—William D. Lanyi

(57) ABSTRACT

An airflow control mechanism is provided to control the flow of air through an opening formed in a portion of a cowl of an outboard motor. The airflow control mechanism is configured to be moveable between a first position and the second position to affect the magnitude of air flowing through an air passage defined as being the space between the opening formed in the cowl and an exit through which the air can leave the cavity of the cowl. The airflow control mechanism can control the flow of air as a function of an operating characteristic of the engine, such as its operating speed, the load on the engine, or the operating temperature of the engine.

8 Claims, 4 Drawing Sheets

MARINE PROPULSION DEVICE WITH VARIABLE AIR INTAKE SYSTEM

BACKGROUND OF THE INVENTION

1. Field of the Invention

The present invention generally relates to marine propulsion devices and, more particularly, to an outboard motor which has an opening formed in the cowl and a mechanism that enables the flow of air into the cavity of the cowl to be controlled.

2. Description of the Prior Art

Those skilled in the art of marine propulsion systems are familiar with many different types of outboard motor designs, including many different types of cowls used to cover and protect the internal combustion engine of the outboard motor and its related components.

U.S. Pat. No. 4,722,709, which issued to Irwin et al. on Feb. 2, 1988, describes a marine propulsion device cowl assembly. The marine propulsion device comprises a propulsion unit including a rotatably mounted propeller and an engine drivingly connected to the propeller. A cowl assembly encloses the engine. The cowl assembly has an interior and includes a bottom wall having therein an opening, and a chimney extending upwardly from the bottom wall for conducting air from the opening to the interior of the cowl assembly.

U.S. Pat. No. 4,734,070, which issued to Mondek on Mar. 29, 1988, describes marine propulsion device air intake system. The device comprises a propulsion unit including a rotatably mounted propeller and an engine drivingly connected to the propeller and including an air intake. It also comprises a cowl assembly surrounding the engine and including a front located adjacent the air intake and a rear including an air inlet. It comprises a baffle for isolating air from the engine and for conducting the air around the engine from the air inlet to the air intake.

U.S. Pat. No. 6,302,749, which issued to Tawa et al. on Oct. 16, 2001, describes an outboard motor that has a first case member and a second case member connected to the first case member to form an enclosure having an inner space in which is mounted an engine. The first case member has an air intake hole for taking air into the inner space and a vent hole for exhausting the air after it circulates in the inner space to cool the interior of the inner space. An alternator is disposed in the inner space of the enclosure and has a hollow casing, air passage holes formed in the hollow casing, and cooling fans for drawing air from the air passage holes into the hollow casing to cool the alternator. A cover member is disposed in the inner space of the enclosure and covers at least a portion of the alternator. The cover member has a vent hole communicating with the vent hole of the first case member, an upper wall, a side wall extending from the upper wall and surrounding the portion of the alternator, and air passage holes formed in the side wall for introducing air there through into the cover member and through the air passage holes of the alternator hollow casing to cool the alternator before the air is discharged from the vent hole of the cover member. An electric equipment box is disposed in the engine room at a position intermediate the air intake hole of the engine cover and the alternator.

U.S. Pat. No. 5,573,436, which issued to Trudeau et al. on Nov. 12, 1996, describes a semi-submersible outboard motor cover with an air passage. The improved cover is intended for use with outboard motors. A particular embodiment of the cover is formed by a generally hollow shell having an open side. An air passage is located opposite the open side at an upper portion of the shell. A baffle extends from an upper inner portion of the shell to an elevation below the air passage and is disposed generally opposite the air passage. An exit port is provided at the bottom of the chamber for discharging water collected therein and a valve is provided within the exit port. When the exit port is submerged, the valve is closed and provides a barrier to water entry. Preferably, the cover is located at an upper forward portion of the outboard motor cowl and the both the air passage and air inlet are high up on the upper forward portion.

U.S. Pat. No. 5,052,353, which issued to Dunham, et al. on Oct. 1, 1991, describes a marine propulsion devise cowl assembly. A marine propulsion device comprises a lower unit, a propeller shaft rotatably supported by the lower unit and adapted to support a propeller, an engine supported by the lower unit and drivingly connected to the propeller shaft and a cowl assembly surrounding the engine and including a lower cover member having an upper end, an upper cover member having a lower end, a seal located between the upper end and the lower end, and interengaging mechanisms on the seal and on one of the upper and lower cover members for securing the seal to the one of the upper and lower cover members.

U.S. Pat. No. 4,860,703, which issued to Boda et al. on Aug. 29, 1989, discloses a cowl assembly with water resistant air intake duct and sealing.

The outboard marine motor is housed by a cowl assembly having an upper cowl section and a lower cowl section and includes various features for improving the structural integrity of the cowl assembly and for providing a water-resistant seal at the joint between the cowl sections and at various points of entry of cables and other mechanical devices. An improved air intake duct prevents the entry of water into the interior of the cavity of the cowl assembly. The air intake duct is disposed in an air intake opening provided in the top rear portion of the upper cowl section. The duct includes a bottom wall, a pair upstanding side walls connected thereto, and an upstanding back wall extending between the side walls.

U.S. Pat. No. 6,413,131, which issued to Phillips et al. on Jul. 2, 2002, disclosed an airflow system for an outboard motor. The outboard motor is provided with an air duct located within the cavity of a cowl of an outboard motor. The air duct defines a chamber within it in association with first and second openings that allow heated air to flow, through the creation of convection currents, out of the engine compartment under a cowl. This convection flow removes heat from the fuel system components and reduces the likelihood that "vapor lock" will occur subsequent to the use of the internal combustion engine that is followed by turning the engine off.

U.S. Pat. No. 6,056,611 which issued to House et al. on May 2, 2000, discloses an integrated induction noise silencer and oil reservoir. An oil reservoir is used as a sound attenuator in an outboard motor and is placed under the cowl of the outboard motor with the throats of the engine's throttle bodies disposed between the oil reservoir and the engine itself. This allows the sound emanating from the throttle bodies to be attenuated by the oil reservoir which is cup-shaped to partially surround the throat of the throttle bodies. A plate member can be attached to a hollow wall structure in order to enclose a cavity therebetween. The structure therefore serves as an oil reservoir for the engine and also as a sound attenuating member.

The patents described above are hereby expressly incorporated by reference in the description of the present invention.

It is well known that certain openings are provided in cowl structures for the purpose of allowing air to flow from the region surrounding an outboard motor toward the internal cavity within the cowl structure surrounding an internal combustion engine. This airflow, from outside the outboard motor, provides two important functions. It allows additional air to be directed to the throttle body structure at the air intake of the engine, when the engine is operating at high speed, and it also allows cooler ambient air to be directed to the region surrounding the engine and its associated components. The introduction of cool ambient air removes heat from the engine and allows the operating temperature of the engine to be more accurately controlled.

It would be significantly beneficial if a system could be provided that allows the flow of ambient air into the region within the cowl structure in a manner that is more accurately controlled as a function of a preselected operating condition of the engine. The operating condition of the engine can be its operating speed or, alternatively, the operating temperature of the engine.

SUMMARY OF THE INVENTION

An engine control system, made in accordance with the preferred embodiment of the present invention, comprises a cowl having a cavity which is shaped to receive an engine therein and an opening formed through a portion of the cowl. An air passage within the cavity is provided and the opening is an inlet of the air passage. An airflow control mechanism is disposed in flow control relation with the air passage. The airflow control mechanism is configured to be moveable between a first position and a second position to affect the magnitude of air flowing through the air passage.

A preferred embodiment of the present invention further comprises an engine disposed within the cavity formed by the cowl. The engine has an air intake such as a throttle body structure. An intake conduit of the engine is connected in fluid communication with a throttle body structure of the engine. The air passage can be the fluid connection between the opening and the throttle body structure.

In various embodiments of the present invention, the airflow control mechanism can comprise a rotatable throttle plate or a rotatable air deflection device. It can be disposed proximate the opening of the air passage and the air passage can extend within the cavity between the inlet of the air passage and an outlet of the air passage. The inlet and outlet of the air passage can both be defined by the structure of the cowl. The inlet and outlet of the air passage can be disposed at opposite ends of an air channel which defines the air passage. Alternatively, the air passage can be defined by internal surfaces of the cowl.

The present invention can further comprise a propulsion control module that is connected in single communication with the airflow control mechanism to cause the airflow control mechanism to move between the first position and the second position to affect the magnitude of air flowing through the air passage as a function of an operating characteristic of the engine. The operating characteristic of the engine can be the desired operating speed of the engine or its operating temperature. The airflow control mechanism can be disposed proximate the outlet of the passage. In a preferred embodiment of the present invention, the engine is connected in torque transmitting relation with an outboard motor.

The present invention also comprises a method for controlling an engine control system which, in a preferred embodiment, comprises the steps of providing a cowl, having a cavity which is disposable at least partially around an engine and forming an opening through a portion of the cowl. It further comprises the steps of providing an air passage within the cavity which has the opening as its inlet and disposing an airflow control mechanism in flow control relation with the air passage. It comprises the step of configuring the airflow control mechanism to be moveable between a first position and second position to affect the magnitude of air flowing through the air passage.

A preferred embodiment of the method of the present invention can further comprise the step of disposing an engine within the cavity formed by the cowl, wherein the engine has a throttle body structure. It can further comprise the step of providing an intake conduit of the engine connected in fluid communication with the throttle body structure.

A preferred embodiment of the present invention further comprises the step of providing a propulsion control module connected in single communication with the airflow control mechanism to cause the airflow control mechanism to move between the first position and the second position to affect the magnitude of air flowing through the air passage as a function of an operating characteristic of the engine, which can be its operating speed, the load on the engine, or the operating temperature of the engine.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
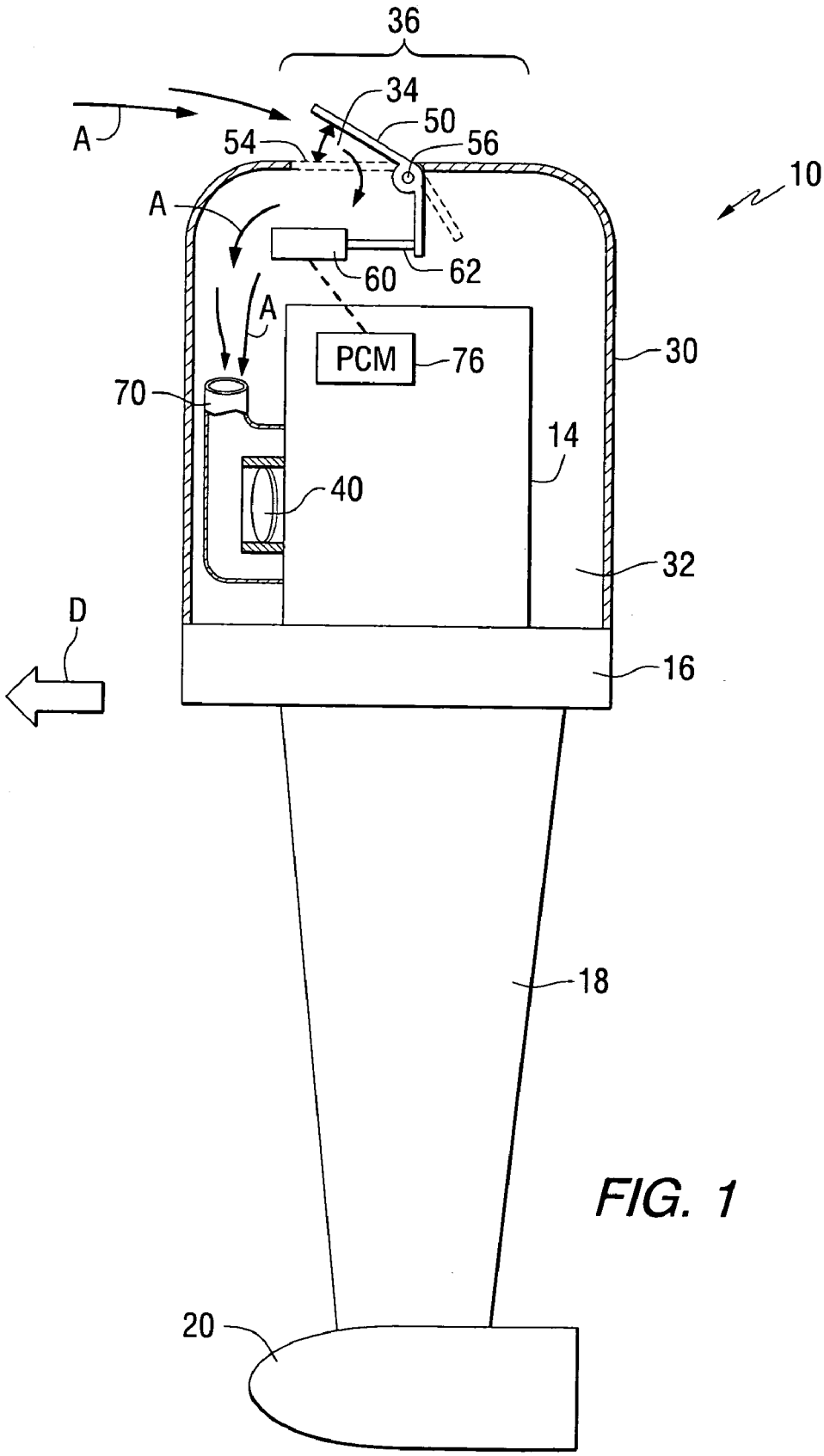
FIG. 1 shows an embodiment of the present invention using a rotatable air deflection device to control the flow of air into the cavity of the cowl.

Throughout the description of the preferred embodiment of the present invention, like components will be identified by like reference numerals.

FIG. 1 is a highly schematic representation of an outboard motor 10 which is intended to operate in the direction represented by arrow D. The schematic representation of the outboard motor 10 includes an engine 14 which is disposed on an adaptor plate structure 16. A downwardly extending drive shaft housing 18 is intended to support a vertical drive shaft that is caused to rotate by the engine 14 and which is connected in torque transmitting relation with a horizontally disposed propeller shaft in a gear housing structure 20. The basic structure of an outboard motor described immediately above is well-known to those skilled in the art.

With continued reference to FIG. 1, the engine control system of the present invention provides a cowl 30 which has a cavity 32 that is shaped to receive the engine 14 therein. The cavity 32 surrounds and provides an enclosure around the engine 14 and its associated peripheral equipment, such as an alternator. An opening 34 is formed through a portion 36 of the cowl. An air passage is provided within the cavity 32. In different embodiments of the present invention, the air passage can be a portion of the cavity 32 itself or various conduits used to restrictively direct air from the opening 34 to the throttle body 40 of the engine. Alternatively, the air passage can direct the flow there from opening 34 to a vent portion of the cowl 30 that allows the air to escape outwardly from the cavity 32.

With continued reference to FIG. 1, an airflow control mechanism 50 is disposed in flow control relation with the air passage which, in the illustration of FIG. 1, is the space between the opening 34 and the throttle body structure 40 or, alternatively, an escape vent through which the air can exit from the cavity 32. The airflow control mechanism 50 is configured to be moveable between a first position, represented by dashed line 54, and the second position which is identified by reference numeral 50. These two positions are achievable by the airflow control mechanism 50 as it pivots about an axis 56. When in the second position 50, air is allowed to flow through the opening 32, as represented by arrows A. When in the first position, the opening 32 is closed and air is inhibited from flowing into the cavity 32 through the opening 34. In the embodiment shown in FIG. 1, a hydraulic cylinder 60 is used with a linkage 62 to actuate the airflow control mechanism between its two positions.

The engine 14 is disposed within the cavity 32 which is formed by the cowl 30. As described above, the engine 14 can have a throttle body structure 40 toward which air is directed by an air intake manifold structure 70. In the embodiment shown in FIG. 1, the air passage is defined as the space under the cowl between the opening 34 and the air intake manifold 70 with its throttle body structure 40. Alternatively, a vent could be provided in the cowl 30 and the air passage would alternatively be defined as the space between the opening 34 and that vent. Depending on the intended function of the present invention, the air passage can be used to direct additional air to the throttle body structure 40 or, alternatively, to direct a flow of cooling air in thermal communication with the engine 14 and its associate components. In the embodiment shown in FIG. 1, the airflow control mechanism 50 comprises a rotatable air deflection device as shown.

A propulsion control module (PCM) 76, is illustrated as being connected in signal communication with the hydraulic device 60. In this way, the propulsion control module 76 can selectively actuate the hydraulic cylinder 60 to move the airflow control mechanism 50 between its alternative positions, identified by reference numerals 50 and 54. By opening and closing the airflow control mechanism, the propulsion control module 76 can respond to changes in the operating characteristic of the engine 14, which can be its operating speed, the load on the engine, or its operating temperature. Although a propulsion control module 76 or a similar control device is intended for use in most embodiments of the present invention, the propulsion control module 76 is not illustrated in each of the figures which will be described below.

Figure 2:
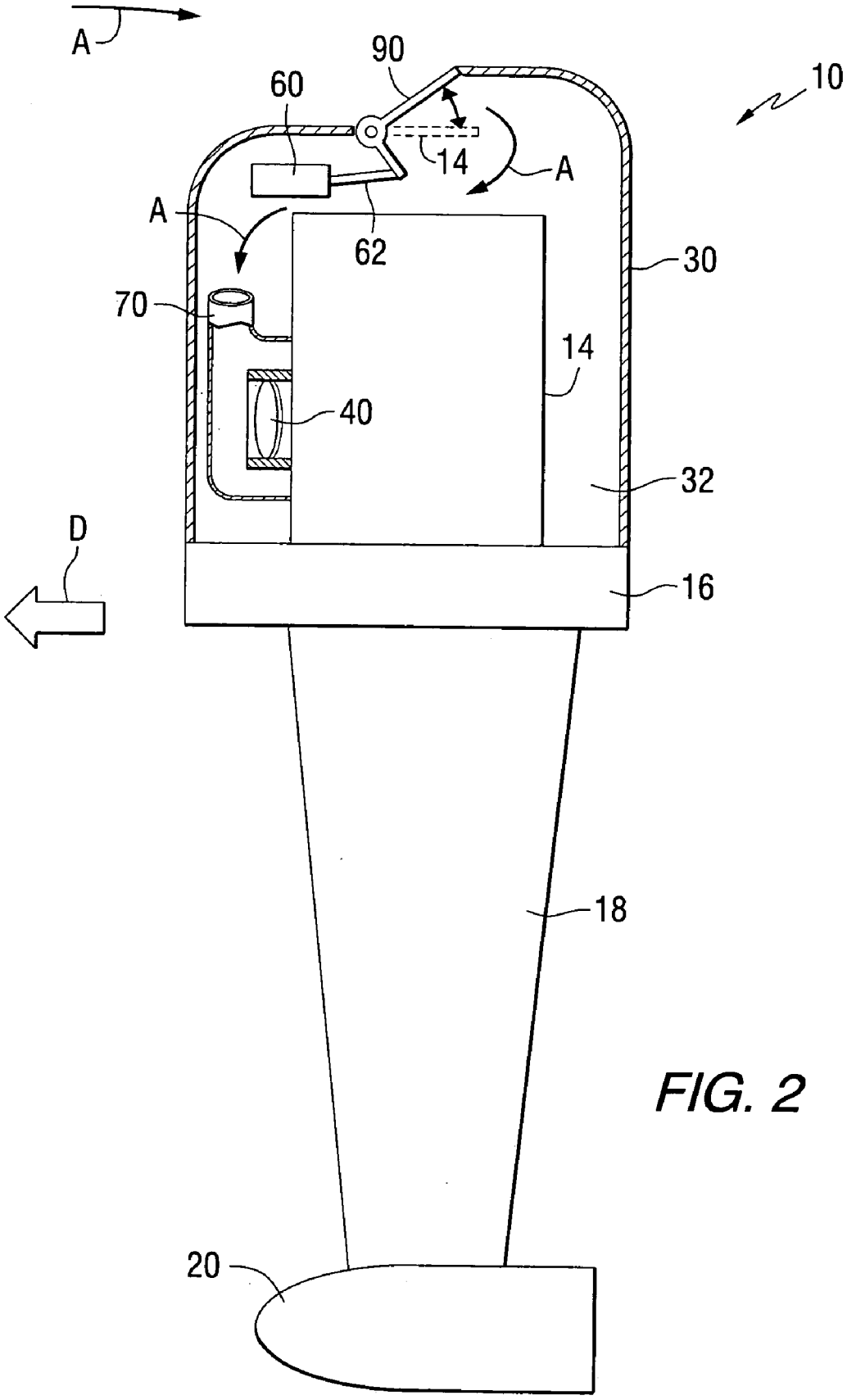
FIG. 2 is an embodiment of the present invention showing a moveable door which operates as an airflow control mechanism.

In FIG. 2, the basic structure of the outboard motor 10 is the same as that shown in FIG. 1, but with an airflow control mechanism 90 that is configured slightly differently from the airflow control mechanism 50 described above. The airflow control mechanism 90 can move to two different positions which are identified as the solid line representation 90 and the dashed line representation 94. A hydraulic cylinder 60, or similar actuator device, can move a linkage 62 to move the airflow control mechanism 90 between its first and second positions which, alternatively, allow a flow of air to enter the cavity 32 as represented arrows A or be forced to flow around the outside of the cowl 30 and not enter the cavity 32.

Figure 3:
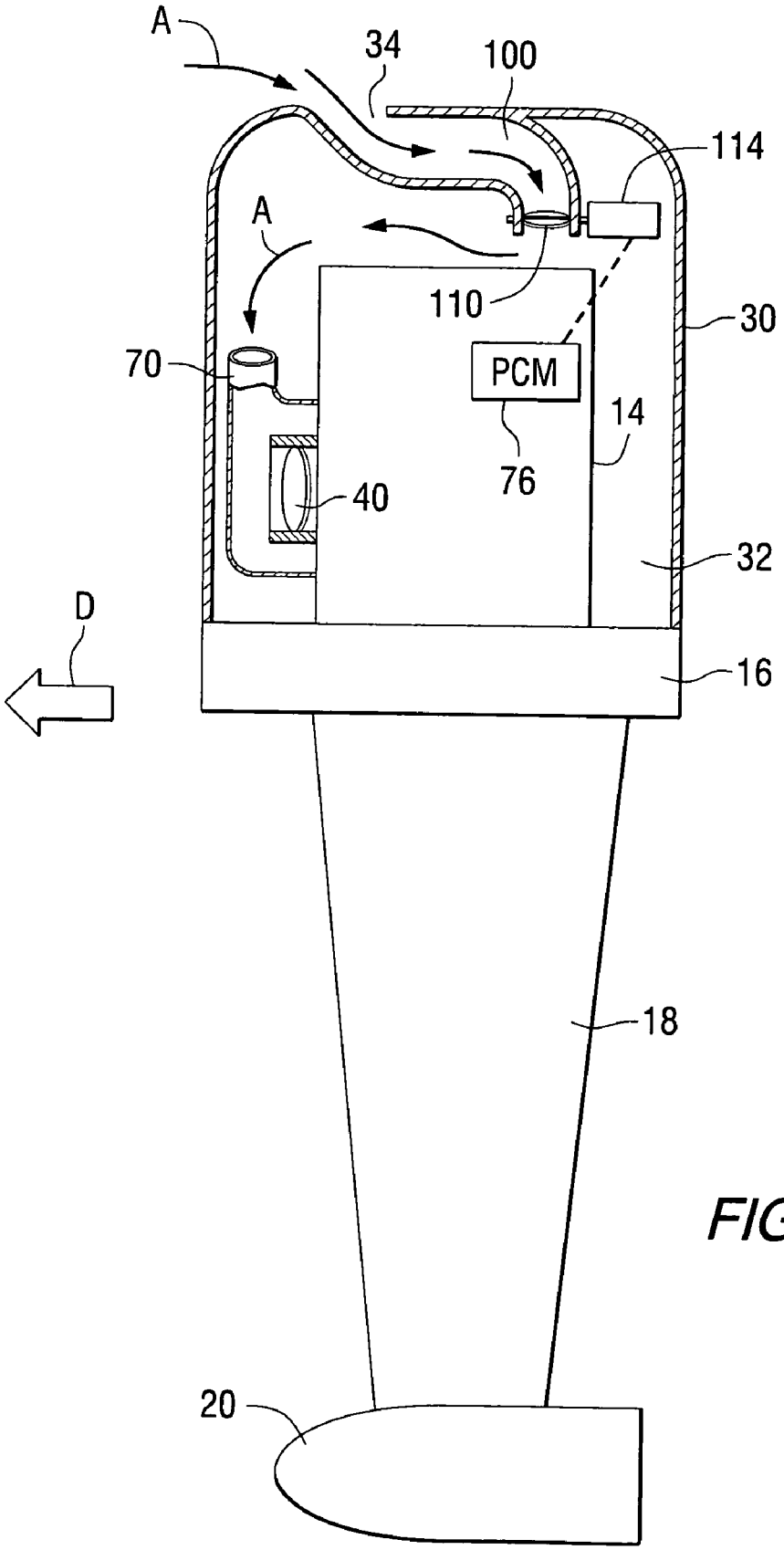
FIG. 3 shows the provision of a conduit through which the flow of air can be controlled from a position outside the cowl of an outboard motor to a region surrounding and engine.

The embodiment of present invention shown in FIG. 3 differs from the embodiments in FIGS. 1 and 2 by the additional provision of a conduit 100 that is formed as part of the cowl 30 to direct the flow of air, as represented by arrows A, from a position outside the cowl 30 to the region surrounding the engine 14. The conduit 100 provides a more structured and restrictive portion of the air passage in comparison to the more open air passages described above in conjunction with FIGS. 1 and 2. During a portion of the air travel from the opening 34 toward the area surrounding the engine 14, the air is restricted to the air passage provided by the conduit 100. To control the flow of air through the conduit 100, a rotatable throttle plate-like device 110 is provided within the conduit 100 and controlled by a stepper motor 114 which, in turn, is controlled by the propulsion control module 76. By causing the throttle plate-like device to rotate about its axis within the conduit 100, the flow of air through the air passage from the opening 34 toward the engine 14 can be controlled. In the embodiment shown in FIG. 3, the airflow control mechanism comprises the stepper motor 114 and the throttle plate-like device at the outlet of the conduit 100. By closing the outlet of the conduit 100, airflow from the opening 34 toward engine 14 can be inhibited.

Figure 4:
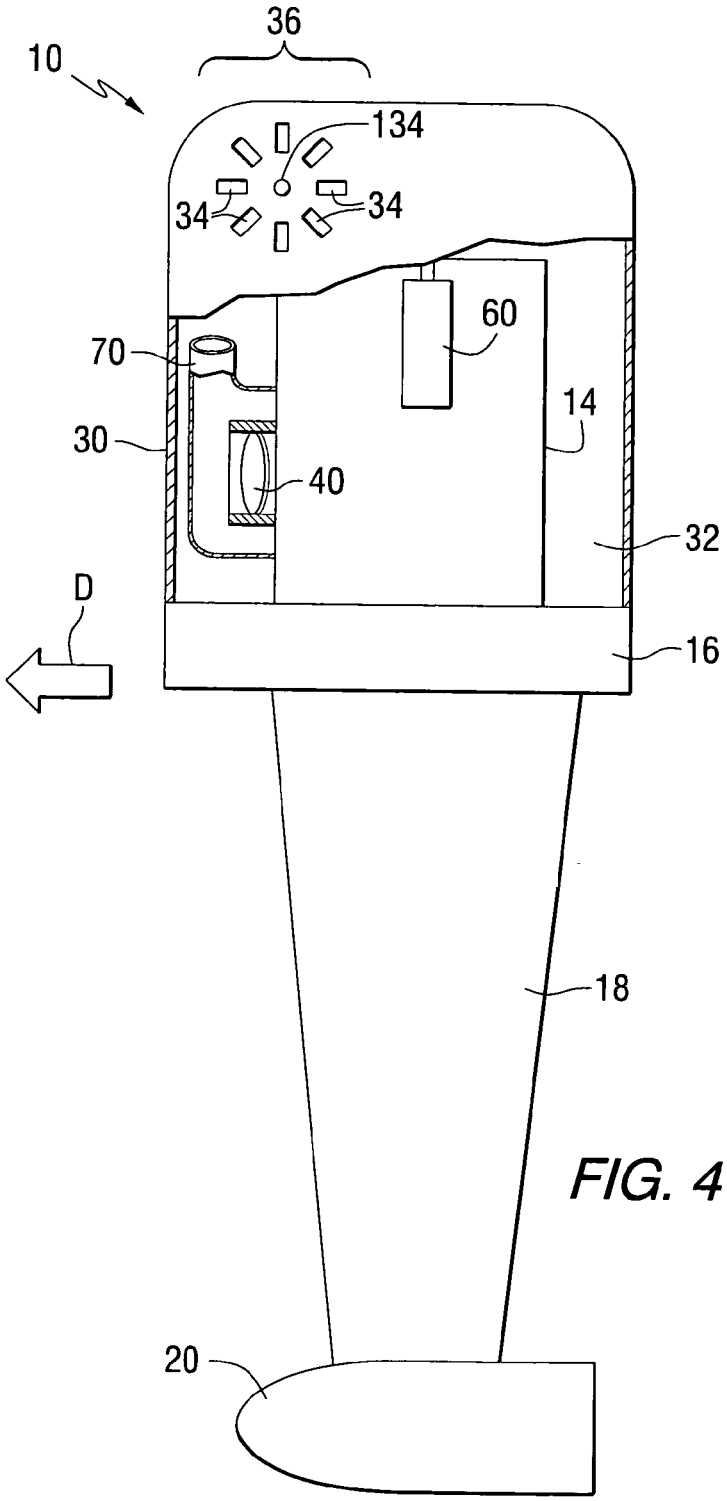
FIG. 4 shows an embodiment of the present invention that uses a plurality of openings that can be opened or blocked by an airflow control mechanism.
Figure 5:
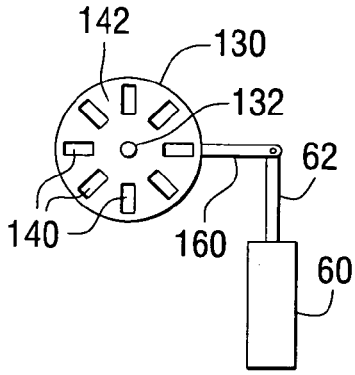
FIG. 5 shows the portion of the mechanism of FIG. 4 which is not visible in FIG. 4.

FIGS. 4 and 5 show an alternative embodiment of the present invention in which the opening 34 is a plurality of openings formed through the structure of the cowl 30. The openings 34 are generally stationery. FIG. 5 shows a structure of a rotatable member 130 that is attached to the inside surface of the cowl so that the pivot 132 of the rotatable structure 130 coincides with the pivot 134 in the center portion of the openings 34. By rotating the rotatable portion 130 about its pivot 132, the openings 34 can be selectively opened or blocked by the openings 140 formed in the rotatable portion 130 or the spaces between those openings 140, which is identified by reference numeral 142, alternatively. A hydraulic device 60 can be used in conjunction with a linkage 62 to exert force on the arm 160 so that the rotatable member 130 is caused to rotate about the pivot point identified by reference numerals 132 and 134. In this way, air can be selectively allowed to flow through the openings 34 or inhibited from flowing through those openings, under the direction of a propulsion control module, such as those described above.

Although the present invention has been described in particular detail and illustrated to show a preferred embodiment, it should be understood that alternative embodiments are also within its scope.

I claim:

1. An engine control system, comprising:

a cowl having a cavity which is disposable at least partially around an engine;

an opening formed through a portion of said cowl;

an air passage within said cavity, said opening being an inlet of said air passage;

an air flow control mechanism disposed in flow control relation with said air passage, said air flow control mechanism comprising a rotatable valve plate, said air flow control mechanism being configured to be movable between a first position and a second position to affect the magnitude of air flowing through said air passage, said air passage extending within said cavity between said inlet of said air passage and an outlet of said air passage; and an engine disposed within said cavity formed by said cowl, said engine having a throttle body structure.

2. The engine control system of claim 1, further comprising:

an intake conduit of said engine disposed in fluid communication with said throttle body structure of said engine.

3. The engine control system of claim 2, wherein:

said air passage is a fluid connection between said opening and said throttle body structure.

4. The engine control system of claim 3, wherein:

said air flow control mechanism comprises a rotatable air deflection device.

5. The engine control system of claim 3, wherein:

said air flow control mechanism is disposed proximate said opening.

6. The engine control system of claim 3, wherein:

said inlet and outlet of said air passage are both defined by the structure of the cowl.

7. The engine control system of claim 1, wherein:

a propulsion control module connected in signal communication with said air flow control mechanism to cause said air flow control mechanism to move between said first position and said second position to affect the magnitude of air flowing through said air passage as a function of an operating characteristic of said engine.

8. The engine control system of claim 1, wherein:

said engine is connected in torque transmitting relation with an outboard motor.

* * * * *